US005371963A

United States Patent [19]

Gallagher

[11] Patent Number: 5,371,963

[45] Date of Patent: Dec. 13, 1994

[54] DISPLAY APPARATUS FOR DESIRED ITEMS WITH EASY EXCHANGE OF DESIRED ITEMS, AND WITH PROTECTION FROM ULTRA-VIOLET LIGHT

[76] Inventor: Gerald B. Gallagher, 9 Main St., P.O. Box 2085, Acton, Mass. 01720

[21] Appl. No.: 807,992

[22] Filed: Dec. 16, 1991

[51] Int. Cl.[5] ..... B44C 5/02

[52] U.S. Cl. ..... 40/158.1; 40/152

[58] Field of Search ..... 40/158.1, 159, 156, 40/157, 124.2, 124, 152

[56] References Cited

U.S. PATENT DOCUMENTS

| | | | |
|---|---|---|---|
| 3,371,439 | 3/1968 | Smith et al. | 40/156 |
| 4,345,394 | 8/1982 | Sullivan | 40/124.2 X |
| 4,794,714 | 1/1989 | Weisgerber | 40/152 |
| 5,148,618 | 9/1992 | Brewster | 40/152 X |

*Primary Examiner*—James R. Brittain
*Assistant Examiner*—Milton Nelson, Jr.

[57] ABSTRACT

A display system for a plurality of small items, the system featuring easy substitution of a second group of items for a first group of items, and featuring protection of the items from ultra-violet radiation. A transparent plate is mounted within a frame, the transparent plate transparent to light in the visible wavelength range and absorbent in the ultra-violet wavelength range to protect the items from ultra-violet wavelength radiation; a mat is mounted within the frame, as is a retainer to hold the items. A backing board forms a back support in the frame to hold the transparent plate, the items, the mat, and the retainer. The retainer may be a sheet of transparent material having holes formed therein. Pins inserted through the holes anchor the retainer to either the backing board or the mat.

18 Claims, 19 Drawing Sheets

502

DISPLAY APPARATUS FOR DESIRED ITEMS WITH EASY EXCHANGE OF DESIRED ITEMS, AND WITH PROTECTION FROM ULTRA-VIOLET LIGHT

FIELD OF THE INVENTION

This invention relates to the field of display apparatus such as picture frames and the like, and more particularly to protection and retention of desired materials in the picture frame.

BACKGROUND OF THE INVENTION

The permanent support of large desired materials in the window of a mat in a picture frame is accomplished by making the window in the mat slightly smaller than the desired materials, and attaching the desired materials by tape, glue, etc. to the rear of the mat.

The method of making the window in the mat smaller than the desired materials and then supporting the desired materials by attaching them to the mat by tape, glue, etc. is inadequate to mount many items into a picture frame. For example, it is often desired to display in a picture frame a selected item for a temporary time period, and then to exchange a new item for the old. The use of tape or glue is then an inconvenience when exchanging the items to be displayed.

A further inconvenience of the old method of mounting an item in a picture frame arises when it is desired to display several small items in a large window in a mat. An unsatisfactory method currently employed is to attach each small item to a backingboard by tape, glue, corner holders, or some other permanent or semi-permanent adhesive means. The backing board is then placed in the picture frame for the display of the small items. However, the adhesive attachment of the small items to the backing board is undesirable.

Still further, the display of interesting items such as stamps, other philatelic items, baseball cards, unusual monetary currency, or other items of interest within a window of a mat board is not convenient with available techniques. Even further, the protection of displayed items from the harmful effects of ultra-violet radiation from the sun, from fluorescent lights, or from any other source is often necessary. The use of ordinary transparent materials in the picture frame does not protect the desired items from ultra-violet radiation impinging on a frame holding the items for display.

It is desirable to mount a plurality of desired items for display in a picture frame type display system and to be able to easily remove a first set of items and replace them with a second set of items. It is further desirable to protect the displayed items from the harmful effects of incident ultra-violet radiation.

SUMMARY OF THE INVENTION

A display system for an item or a plurality of small items, the system featuring easy substitution of a second group of items for a first group of items, and featuring protection of the items from ultra-violet radiation is provided.

A display assembly has a frame, the frame forming a first opening for the display of desired materials; a transparent plate mounted within the frame and covering the first opening, the transparent plate permitting viewing of desired materials through the first opening and protecting the desired materials, the transparent plate having a first side turned away from an inside of the frame and a second side turned toward the inside of the frame; a mat mounted within the frame, the mat adjacent to the second side of the transparent plate, the mat having a second opening, the second opening forming a window for viewing the desired materials, the second opening in the mat being smaller than the first opening formed by the frame; a retainer to hold the desired materials in the second opening of the mat; a pressure board to compress the materials in the assembly; a backing board to form a back support in the frame to hold the transparent plate, the desired materials, the mat, the retainer, and the pressure board within the frame; attachment means for fastening the backing board within the frame to anchor the backing board to form the back support for the assembly. The transparent plate may be transparent to light in the visible wavelength range and absorbent or reflective in the ultra-violet wavelength range to protect the desired materials from ultra-violet wavelength radiation striking the transparent plate. The transparent plate may be made of glass, plastic, or any other convenient material.

Further, the retainer may be a pliable sheet of transparent material folded to capture the desired items within the fold of the retainer. The retainer is then sized to fit snugly within the frame.

A shaped pressure board is provided to fit between the retainer and the backing board to concentrate compressive forces on the edges of the retainer to better hold it in place between the backing board and the mat. A panel of desired color or design is placed between the retainer and the shaped pressure board so that the pressure board is not visible through the transparent material of the retainer.

A pressure board focuses compressive forces onto portions of the retainer between the mat and the backing board so as to more securely hold the retainer in place. Retainer clips apply compressive forces between the backing board and the mat, and the pressure board focuses these compressive forces onto the retainer.

Still further, the retainer may be a sheet of transparent material having holes formed therein. Pins inserted through the holes anchor the retainer to either the backing board or the mat.

DETAILED DESCRIPTION

Figure 1:
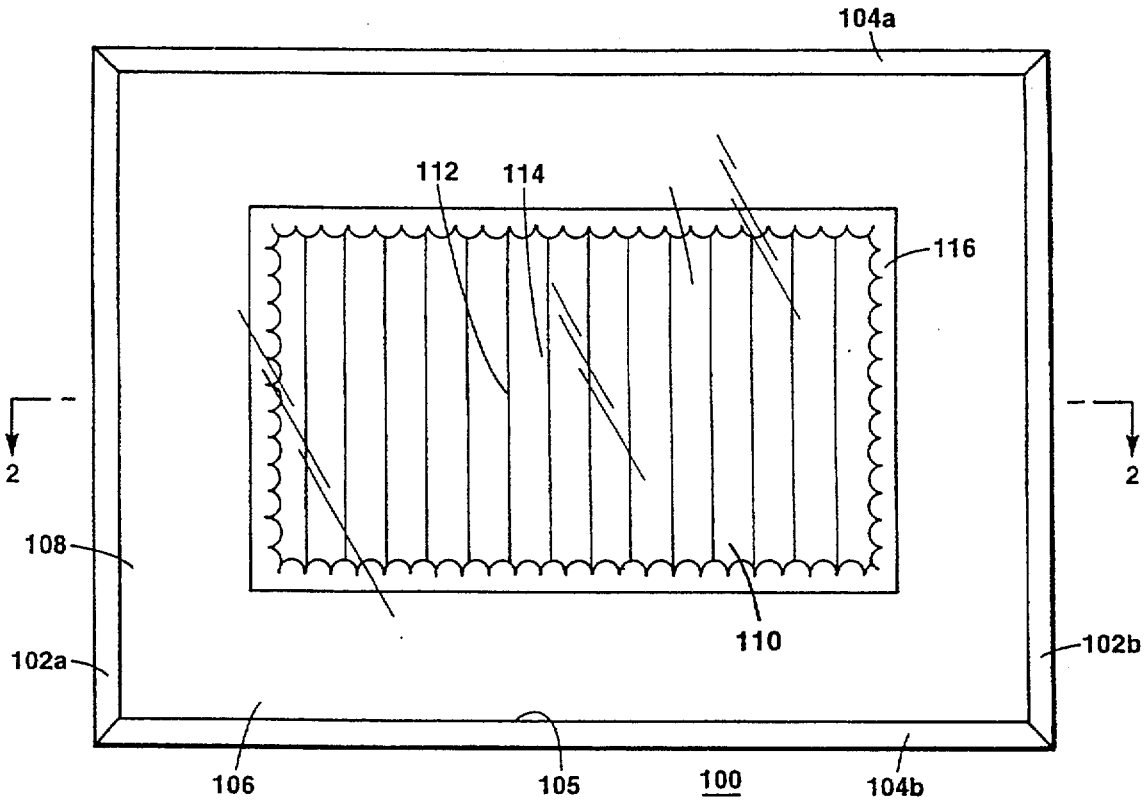
FIG. 1 is a front view of desired items displayed in a picture frame assembly.

In order to further illustrate the advantages and features of the invention, reference should be made to the following detailed description in connection with the accompanying drawings. Throughout the drawings, like reference numbers refer to like features of the present invention represented in the several views. The detailed description encompasses a number of exemplary embodiments, as shown in the drawings.

First Exemplary Embodiment

Beginning with FIG. 1, there is shown a front view of desired materials displayed in picture frame assembly 100. Picture frame assembly 100 is typically constructed of parallel frame legs 102*a*, 102*b* arranged perpendicular to parallel frame legs 104*a*, 104*b*. Frame legs 102*a*, 102*b*, 104*a*, 104*b* may be, for example, conventionally constructed of lightweight aluminum materials. Assembled frame legs 102*a*, 102*b*, 104*a*, 104*b* hold transparent plate 106 with front lip 105, as further shown in FIG. 2.

A fundamental characteristic of the present invention is a unique combination of materials used in picture frame assembly 100. The present invention uses transparent plate 106 composed of ultraviolet absorbing or reflecting material. The preferred embodiment replaces an ordinary sheet of glass with a form of ultraviolet absorbing or reflecting material for transparent plate 106. Absorption of incident ultraviolet light by transparent plate 106 provides maximum protection and preservation of artwork 112 displayed in picture frame assembly 100.

Figure 2:
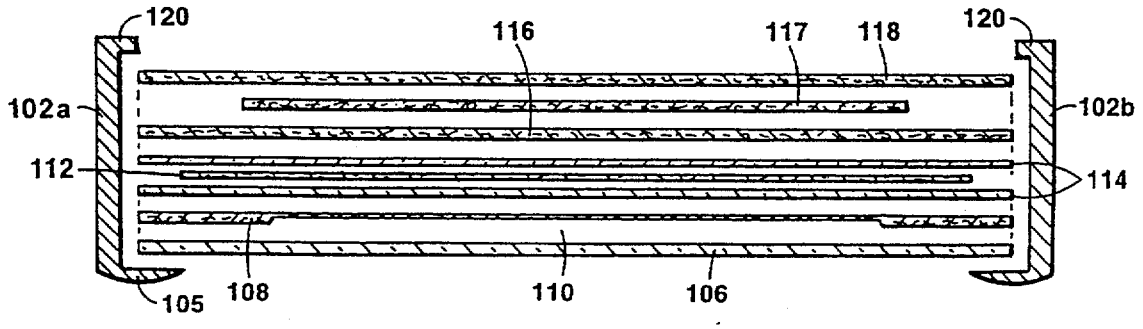
FIG. 2 is a cross sectional view of FIG. 1.
Figure 3:
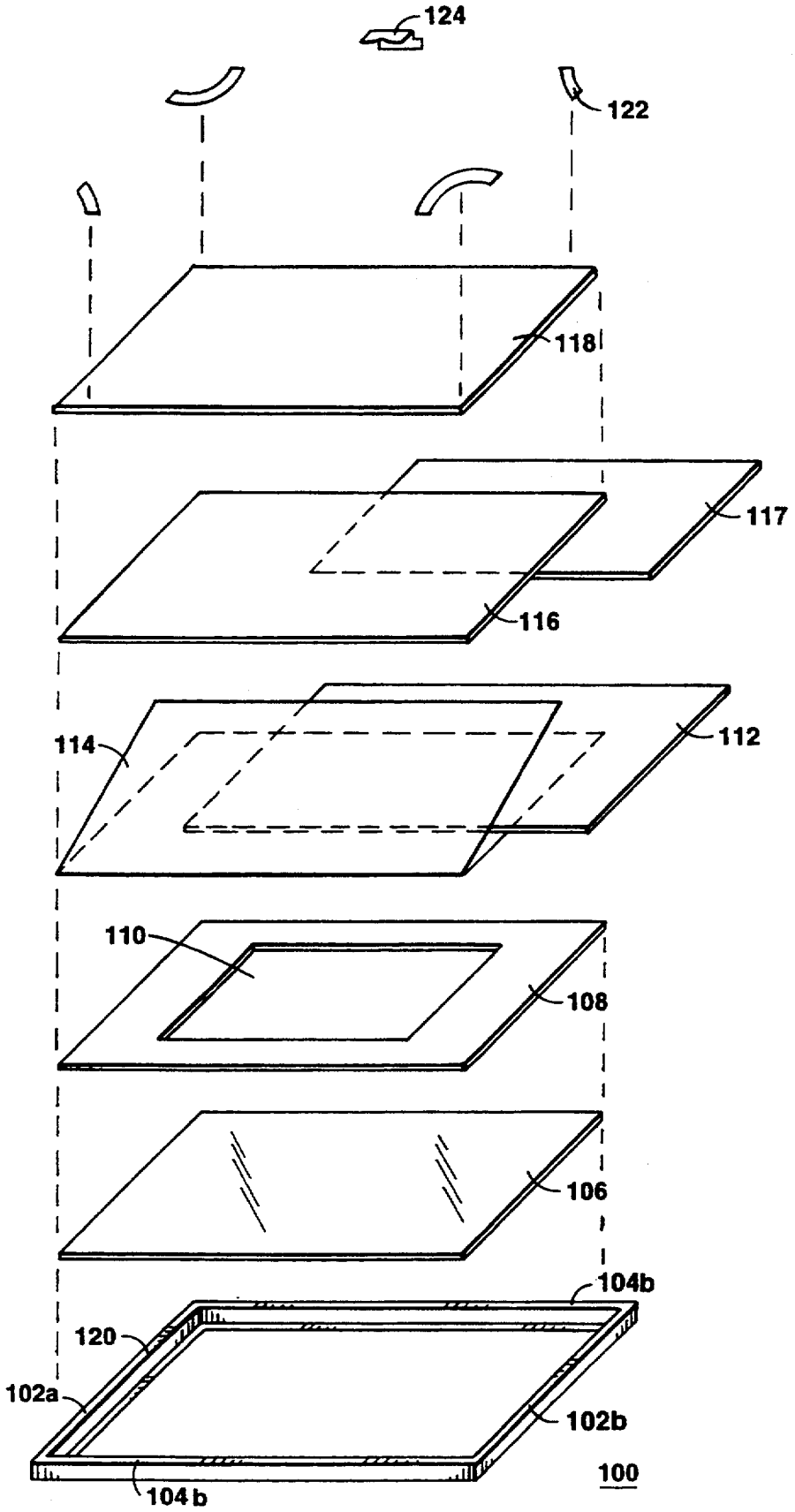
FIG. 3 is an exploded assembly drawing.

In order to best identify remaining elements of picture frame assembly 100 shown in FIG. 1 reference should be made to FIG. 2 in conjunction with FIG. 3. FIG. 2 is a cross sectional view of picture frame assembly 100 taken along line 2—2 in FIG. 1. FIG. 3 is an exploded assembly drawing of picture frame assembly 100. Parts shown in FIG. 2 and 3 are described in the order assembled in picture frame assembly 100.

Mat 108 is assembled against transparent plate 106. Mat 108 is conventionally made of ⅛th inch thick mat board. However, a preferred embodiment uses mat 108 composed of archival quality acid-free material. Again, a focus of the present invention is preservation and protection of artwork 112. Typically, mat 108 is pre-cut to form window 110. Window 110 provides requisite viewing area for display of artwork 112. Mat 108 is readily available in a variety of colors, selected to appropriately accent display of artwork 112. Unlike conventional methods, in the present invention, artwork 112 is not permanently mounted to mat 108. The unique combination of materials eliminates need for permanent mounting. A fundamental feature and inherent advantage of the present invention is the repeated use of mat 108 for different displays, or an easy change of mat 108 for a different color accent.

The method that eliminates need for individual mounting of artwork 112 to mat 108 is introduction of a sheet of foldover MYLAR 114. Foldover MYLAR 114, or similar substance with equivalent flexibility and transparency, functions as a retainer to display artwork 112 through window 110. As shown in the exploded assembly drawing in FIG. 3, foldover MYLAR 114 uniformly encases artwork 112 in a sleeve-like fashion. In order to secure placement of artwork 112 within foldover MYLAR 114, static electricity may be used. Present mounting method may, for example, be employed by rubbing a household cloth on inner fold of foldover MYLAR 114, creating static electricity. In the present embodiment, foldover mylar 114 is sized to snugly fit dimensions of assembled frame legs 102*a*, 102*b*, 104*a*, 104*b* in picture frame assembly 100.

Figure 4:
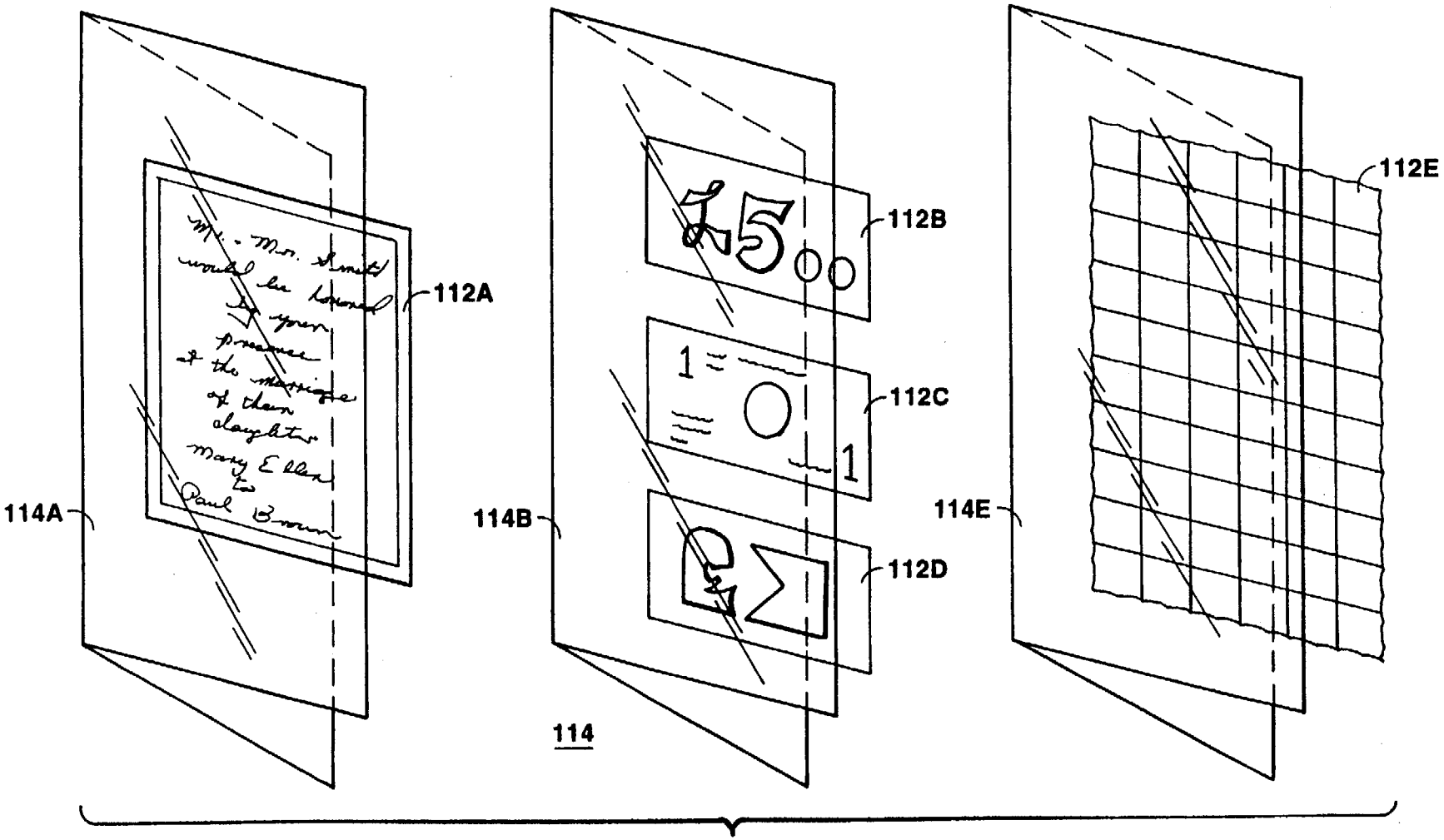
FIG. 4 is an exploded assembly drawing showing a retainer.

By using foldover MYLAR 114, not only is the need for permanent mounting eliminated, but also need for tailor cutting mat 108 is not necessary. Use of foldover MYLAR 114 permits display of varying shaped, sized, and arranged artwork 112 in same picture frame assembly 100. By way of example, FIG. 4 illustrates the simplicity of mounting various materials with foldover MYLAR 114. FIG. 4 is an exploded assembly drawing showing a series of various sized and arranged collector's materials such as stamps, unusual monetary currency, and wedding invitations, shown ensleeved in foldover MYLAR 114. Wedding invitation 112*a* is ensleeved in foldover MYLAR 114*a*. Monetary currency 112*b*, 112*c*, 112*d* is ensleeved in foldover MYLAR 114*b*. Sheet of stamps 112*e* is ensleeved in foldover MYLAR 114*c*.

Not only does use of foldover MYLAR 114 simplify mounting of artwork 112, but such use obviates need for glues, pastes or adhesives. An inherent resulting advantage is prevention of exposure of artwork 112 to undesirable corrosive materials, chemicals, or acids, which may leach out of other mounting materials, papers, etc. Combination of foldover MYLAR 114 with use of transparent plate 106, thus provides maximum protection and preservation of artwork 112 from both corrosive materials and from ultraviolet light.

Continuing with FIG. 3, the next layer in picture frame assembly 100 is decorative sheet 116. Decorative sheet 116 provides background for artwork 112 as viewed through window 110. Decorative sheet 116 is typically a sheet of construction paper, art paper, or material of similar thickness. Again, preferred embodiment uses a decorative sheet 116 composed of archival quality acid-free material. Since decorative sheet 116 is available in a variety of colors, selection of complimentary colors for mat 108 and decorative sheet 116 can accent artwork 112. Functionally, decorative sheet 116 can also serve to "color in" background area for smaller dimension artwork 112, such as unusual monetary currency 112*b*, 112*c*, 112*d* shown in FIG. 4.

An additional component of the mounting method of the present invention is use of pressure board 117. Pressure board 117 is assembled behind decorative sheet 116 in picture frame assembly 100. Pressure board 117 cooperates with foldover MYLAR 114 to provide a novel feature of the present invention. Pressure board 117 operates to secure placement of artwork 112 in picture frame assembly 100. Pressure board 117 is centered behind decorative sheet 116 so as to apply uniform pressure to compress decorative sheet 116, foldover MYLAR 114, and mat 108 against transparent plate 106. Thus positioned, pressure board 117 sandwiches layers of picture frame assembly 100 into a unique permanent mounting assembly, in contrast with former techniques employing permanent mounting.

The final layer in picture frame assembly 100 shown in FIG. 3 is backing board 118. Backing board 118 is typically composed of styrofoam or laminated foam board, sized to snuggly fit in picture frame assembly 100. Thus backing board 118 uniformly engages assembled frame legs 102*a*, 102*b*, 104*a*, 104*b* in picture frame assembly 100. Backing board 118 also functions as a protective closure to picture frame assembly 100.

Figure 5:
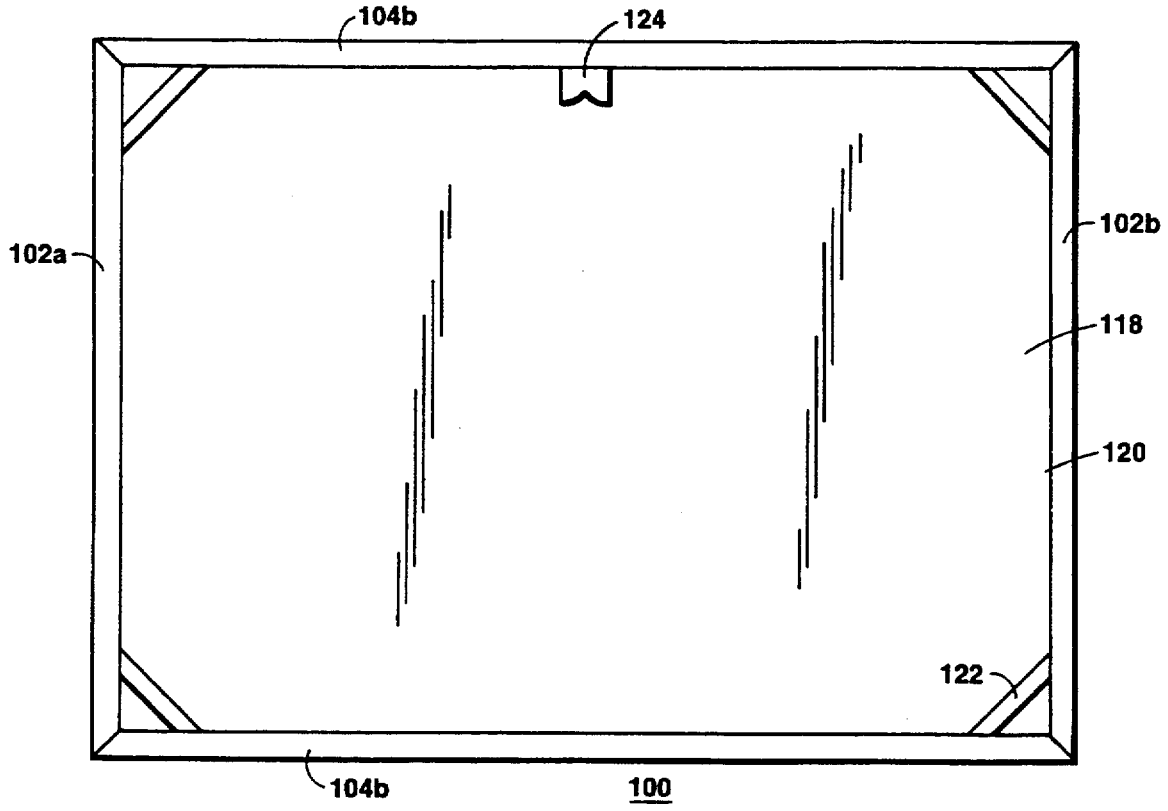
FIG. 5 is a rear view of a picture frame assembly.
Figure 6A:
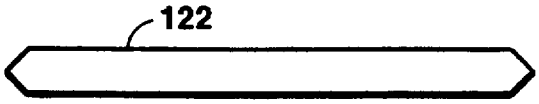
FIG. 6*a* and FIG. 6*b* are views of a retainer clip.
Figure 6B:
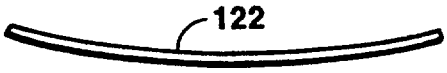

Assembled layers of picture frame assembly 100 are secured in place by retainer clips 122. FIG. 5 is a rear view of picture frame assembly 100. Retainer clips 122 have manufactured convex curvature. FIG. 6*a* is a top view of retainer clip 122, and FIG. 6*b* is a side view of retainer clip 122. Curvature provides requisite resistant pressure to secure placement of retainer clips 122. Curvature enables snapping each end of retainer clip 122 under back lip 120, shown in FIG. 3, of frame leg 102*a*, 102*b*, 104*a*, 104*b*. For example, retainer clip 122 is snapped under back lip 120 of frame leg 102*a* and then engaged at approximately a 45 degree angle under back lip 120 of frame leg 104*a*. Arrangement of four retainer clips on back of picture frame assembly 100 is shown in FIG. 5.

Various means for preparation of picture frame assembly 100 for wall display may be used. For example, a hanger clip 124 may be used. As shown in FIG. 5, hangar clip 124 is snapped under back lip 120, is centered position along frame leg 104*a*.

Second Exemplary Embodiment

Figure 7:
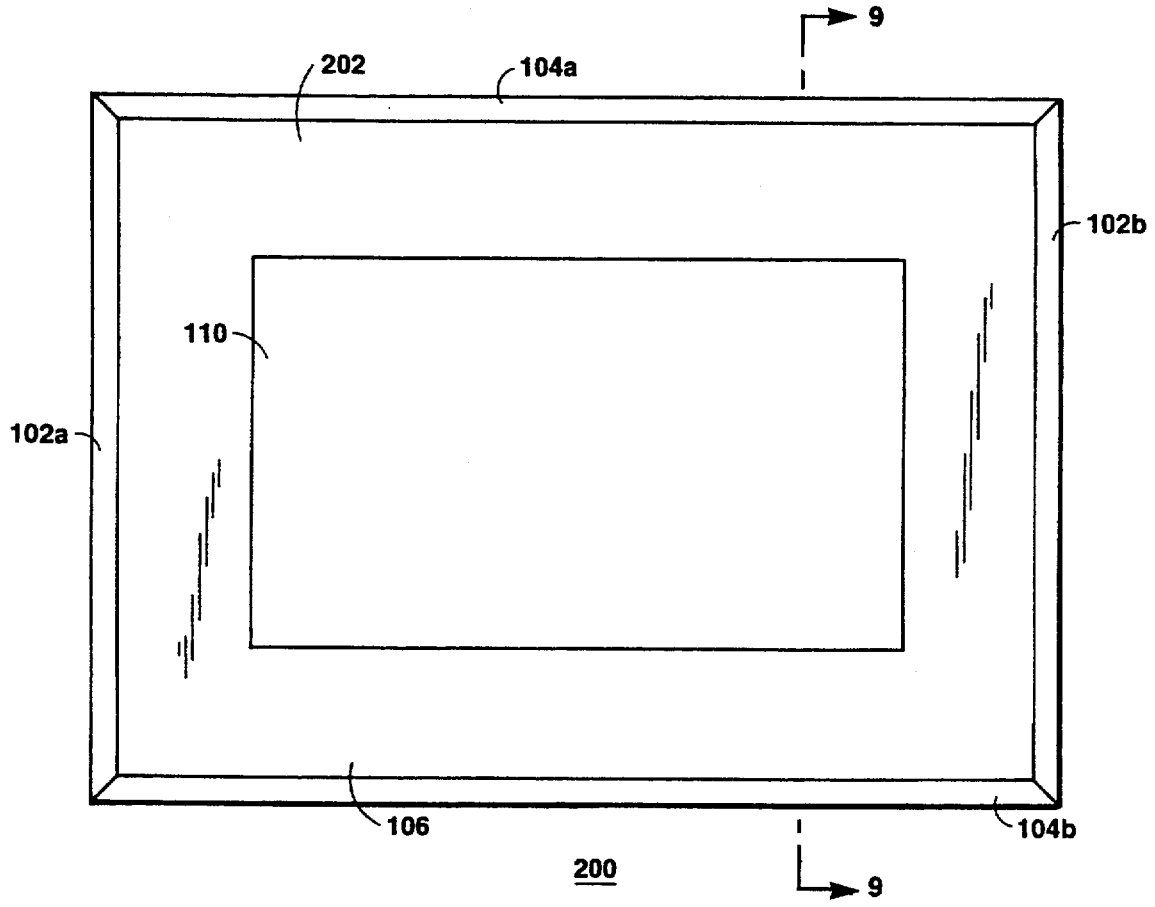
FIG. 7 is a front view of a display frame.

FIG. 7 shows a front view of a second exemplary embodiment of the invention, picture frame assembly 200. In the second exemplary embodiment shown in FIG. 7, mat 202 and backing board 206 are used. An alternative construction and means for mounting is employed with mat 202 and backing board 206, described in detail below. Where like parts from previous embodiment are shown in the figures, like reference numbers are used. Where new parts are introduced in present embodiment, new reference numbers are used.

Figure 9:
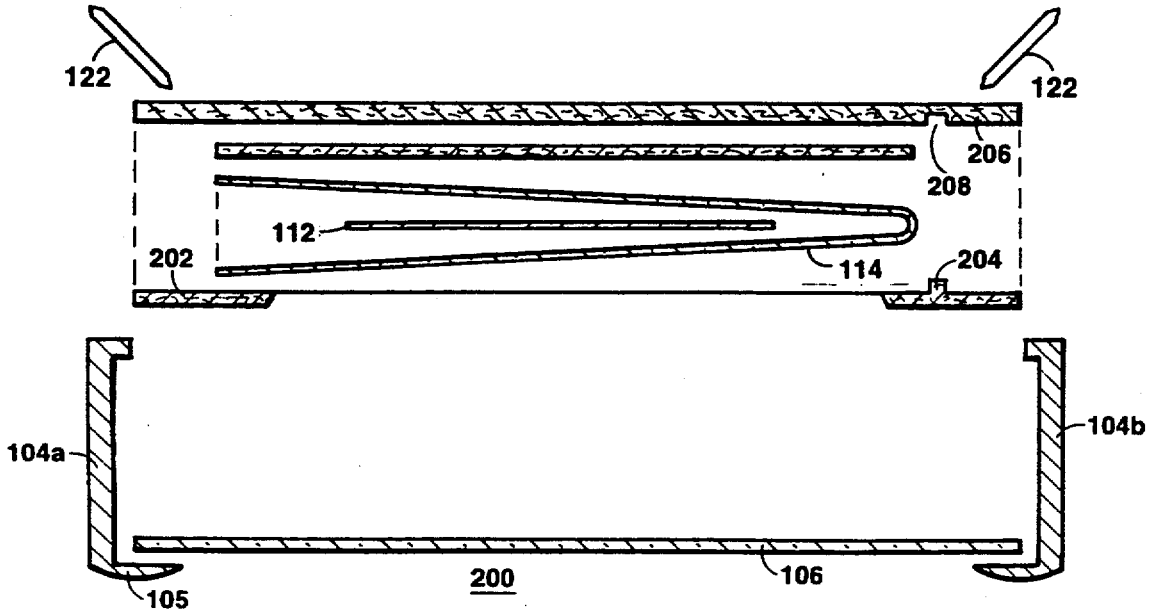
FIG. 9 is a cross sectional view of the picture frame assembly.
Figure 8:
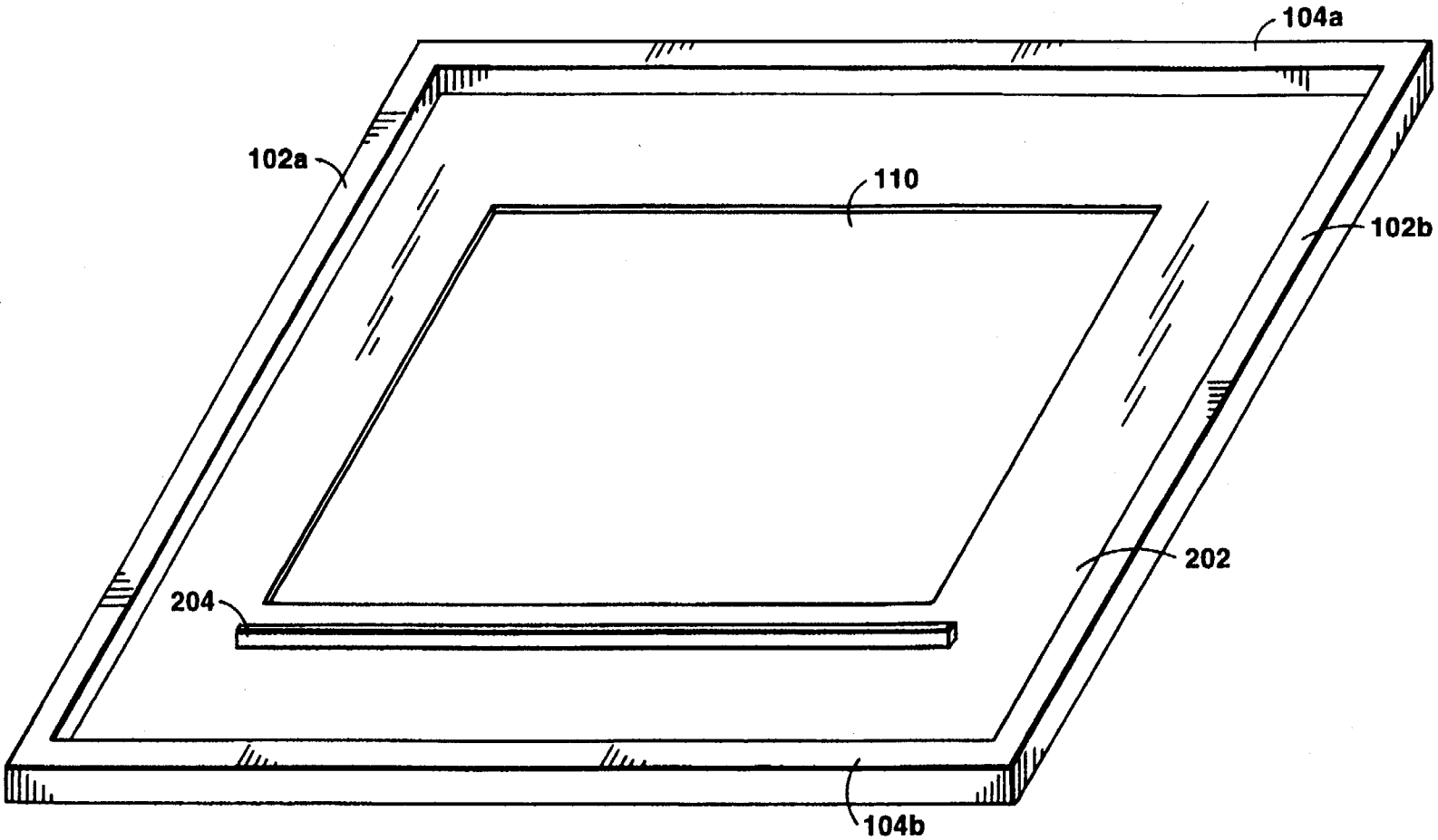
FIG. 8 is an isometric view of a mat having a groove formed therein.
Figure 10:
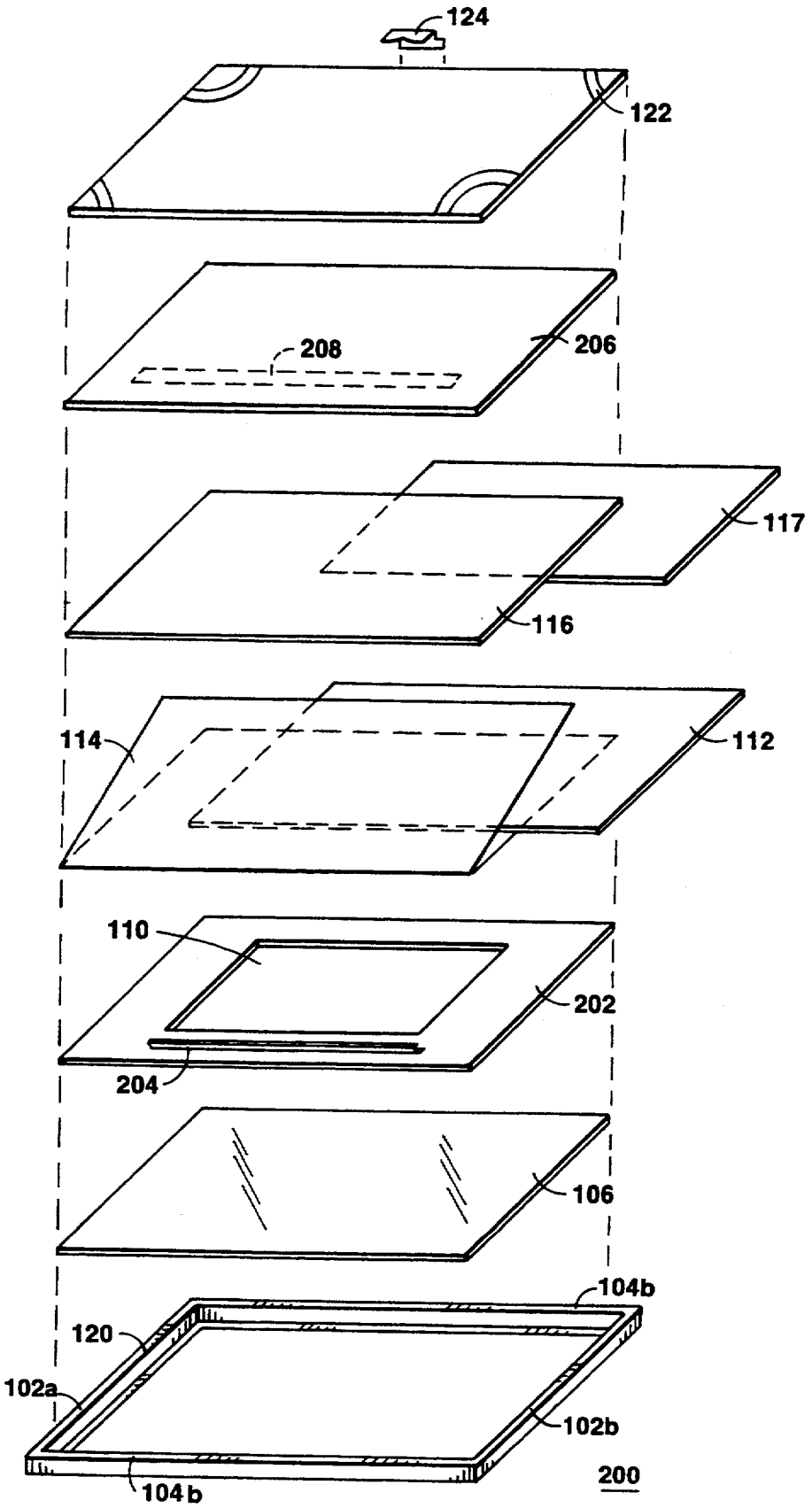
FIG. 10 is an exploded assembly drawing of a picture frame assembly using folded transparent material as a retainer.

Mat 202 is composed of acid free ⅛th inch thick mat board. FIG. 8 is a an isometric view of mat 202. FIG. 9 is a cross sectional view of picture frame assembly 200 taken along line 9—9 shown in FIG. 7. FIG. 10 is an exploded assembly drawing of picture frame assembly 200. As shown in FIG. 8, the present embodiment uses mat 202 constructed with shelf 204. Shelf 204 is attached to backside of mat 202. As shown in FIG. 8, for example, position of shelf 204 is parallel to frame leg 104*a*. Selection of shelf position is dependent on display of artwork 112.

In contrast to the layered pressure assembly described in the first embodiment, the present embodiment employs shelf 204 on mat 202 as an alternative mounting method to suspend artwork 112. Artwork 112 is again uniformly encased by foldover mylar 114. In present embodiment foldover MYLAR 114 is sized to engage, for example, assembled frame legs 102*a*, 102*b*, 104*a*. Foldover MYLAR 114 does not engage frame leg 104*b*, but instead rests against shelf 204. Shelf 204 functions to receive and suspend placement of foldover MYLAR 114 with artwork 112. Decorative sheet 116 is used and also sized to be visible through window 110 of mat 202 in picture frame assembly 200.

Figure 11:
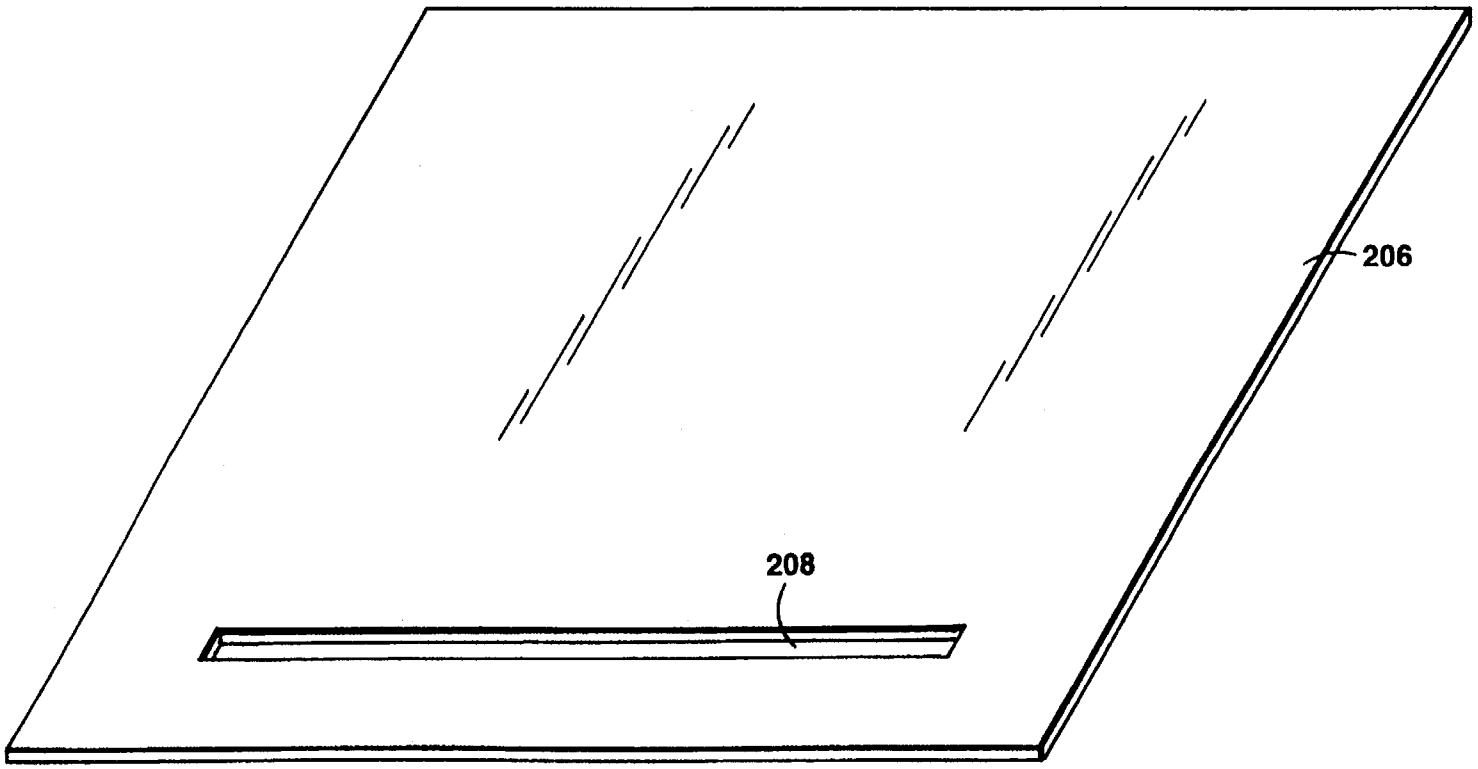
FIG. 11 is an isometric view of a backing board having a groove formed therein.

This second embodiment of the invention uses backing board 206 constructed with groove 208, shown in FIG. 11. Backing board 206 is typically composed of styrofoam or laminated foam board, sized to snugly fit within assembled frame legs 102*a*, 102*b*, 104*a*, 104*b*. Groove 208 is formed on a side backing board 206, facing shelf 204, such that shelf 204 fits into groove 208. The position of groove 208 on backing board 206 depends upon the position of shelf 204 on mat 202. When assembled, shelf 204 fits into groove 208 to securely support artwork 112 and foldover MYLAR 114 in picture frame assembly 200. Pressure from pressure board 117 may be used to compress foldover MYLAR 114 between mat 202 and backing board 206.

Assembled layers of picture frame assembly 200 are secured in place by application of retainer clips 122. Arrangement of retainer clips on back of picture frame assembly 200 is shown as in FIG. 5. As with previous emobdiment, hangar clip 124 may be used to enable wall display of picture frame assembly 200. Placement of hanger clip 124 is shown as in FIG. 5.

Third Exemplary Embodiment

Figure 12:
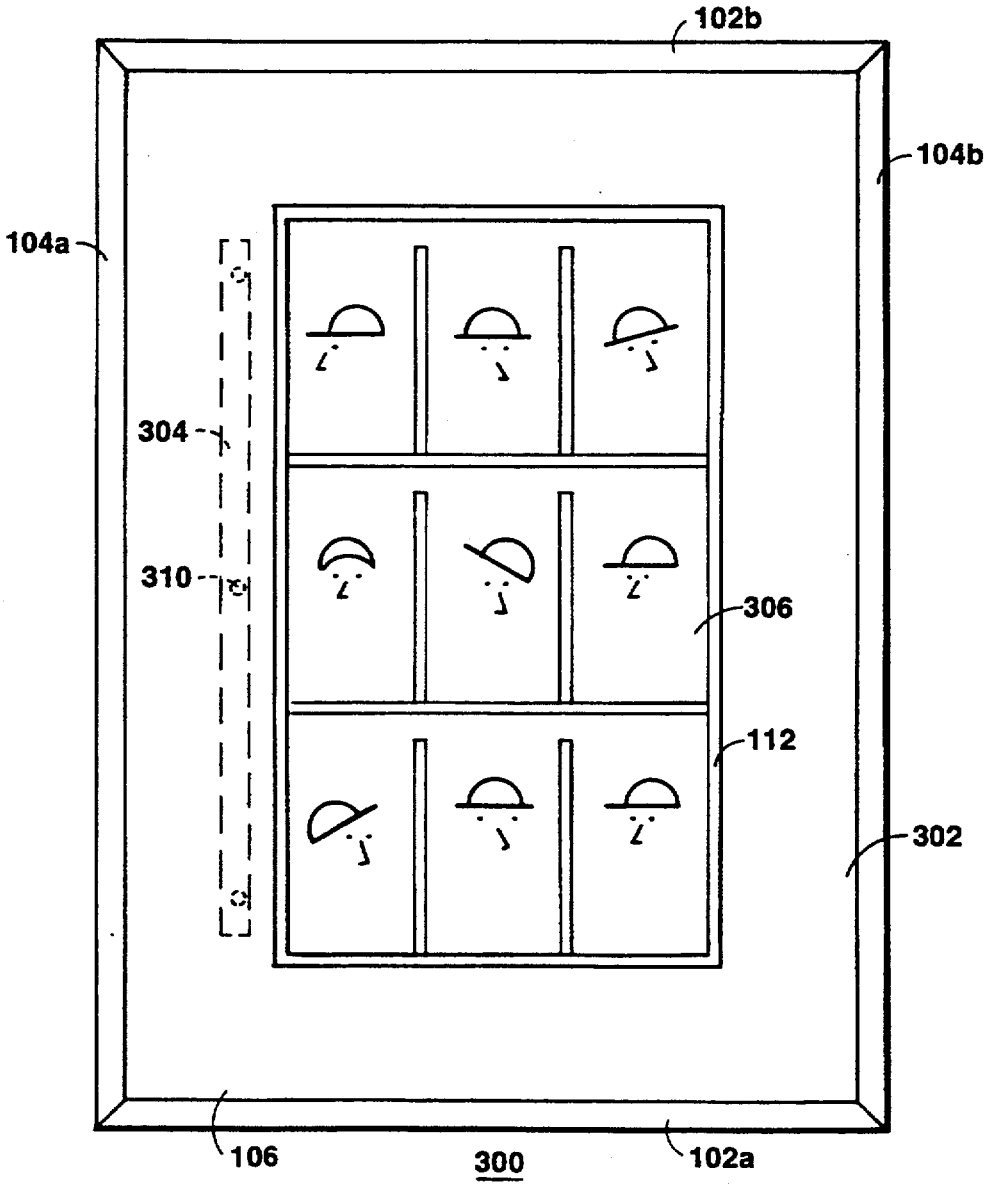
FIG. 12 is a front view of the picture frame assembly having a plurality of desired items mounted therein for display.

Referring now to FIG. 12, there is shown a front view of a third exemplary embodiment of the invention, picture frame assembly 300. In the third exemplary embodiment shown in FIG. 12 mat 302 is used for display of various album pages from collectors materials. FIG. 12, for example, displays an album page 306 of baseball cards. An alternative construction and means for mounting is employed with mat 302, described in detail below. Where like parts from previous embodiment are shown in the figures, like reference numbers are used. Where new parts are introduced in present embodiment, new reference numbers are used.

Figure 13:
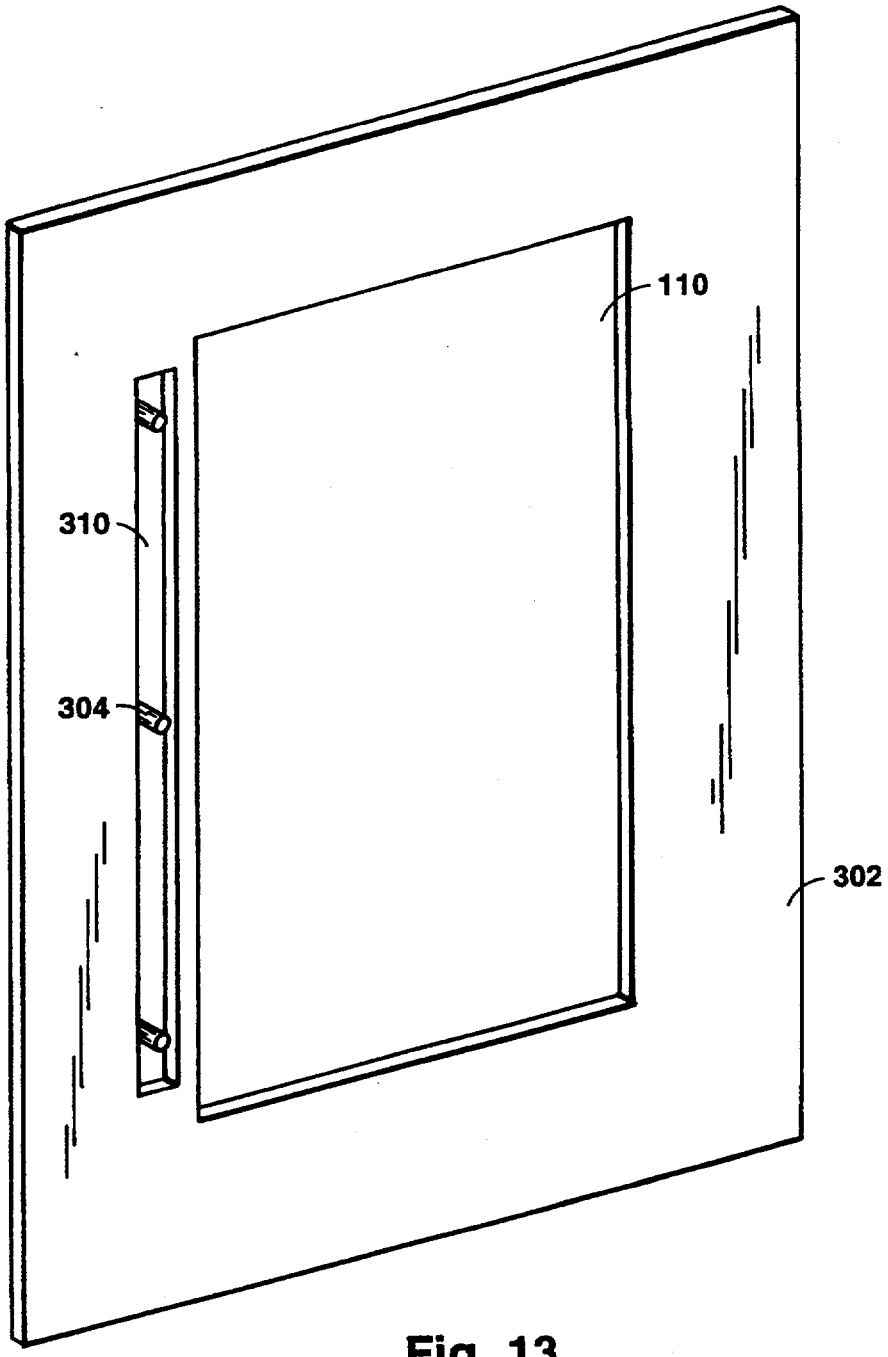
FIG. 13 is a rear view of mat having pins mounted therein.
Figure 14:
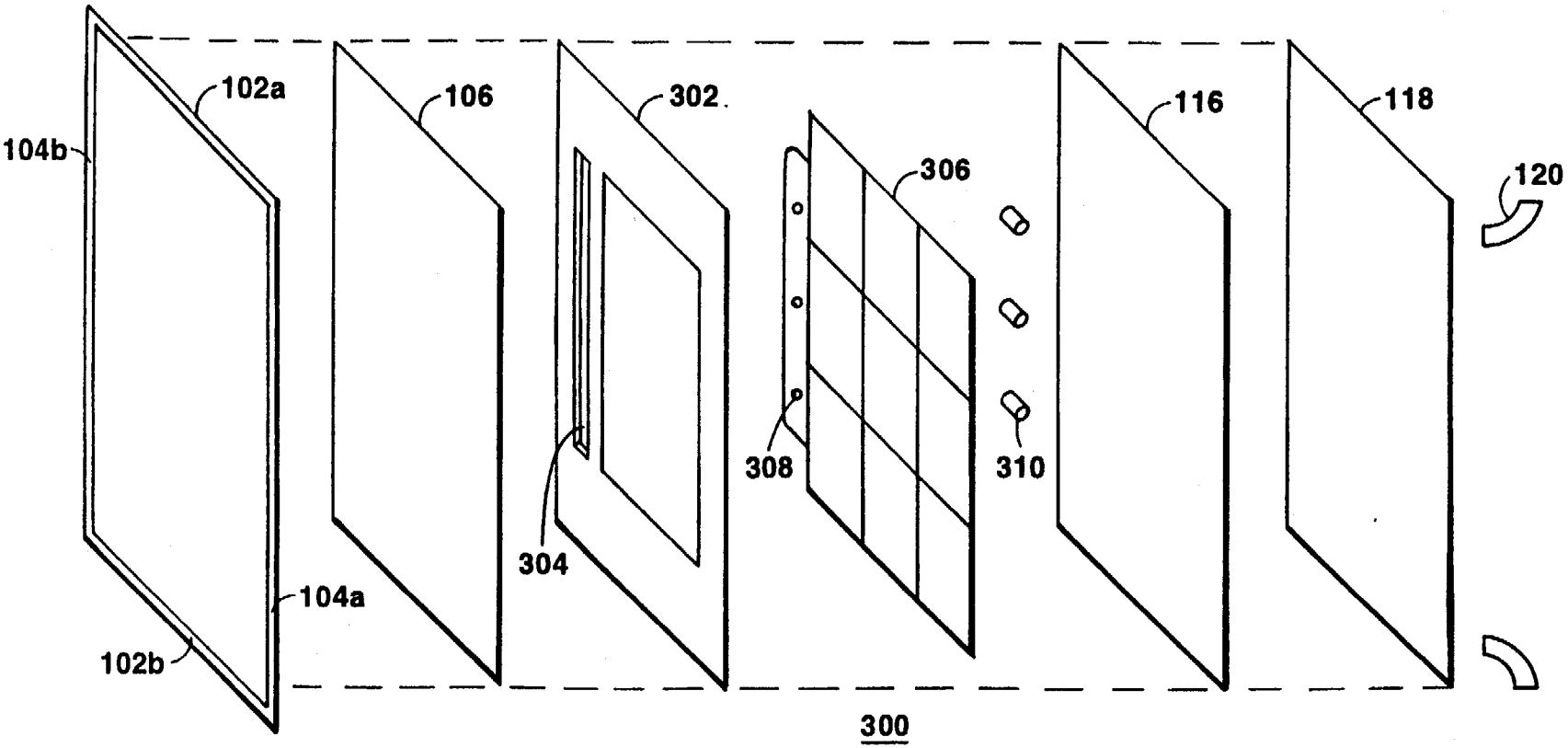
FIG. 14 is an exploded assembly view of the picture frame assembly having pins holding an album page in place.

As with previous embodiments, mat 302 is, for example, composed of acid free ⅛th inch thick mat board. FIG. 13 is a rear view of mat 302. FIG. 14 is an exploded assembly drawing of picture frame assembly 300. An exemplary embodiment uses mat 302 constructed with recessed trough 304. Trough 304 is a slot in mat 302. Position of trough 304 is parallel to frame leg 102*a* or 104*a*.

Trough 304 has pins 310 to mount artwork 112. The pins may, for example, be pegs. Many album pages have pre-existing punched holes. For example, where artwork 112 is an album page 306, pins 310 are placed through existing punched holes 308 of album page 306. FIG. 15 is an isometric view of an album page 306, with existing punched holes 308. Trough 304 receives pins 310 to secure mounting of artwork 112 in picture frame assembly 300. Decorative sheet 116 is sized to snuggly fit assembled frame legs 102*a*, 102*b*, 104*a*, 104*b*. A backing board 118, as shown in FIG. 3 and from the first embodiment, may also be used in present embodiemnt. Backing board 118 is typically composed of styrofoam or laminated foam board, sized to snugly fit within assembled frame legs 102*a*, 102*b*, 104*a*, 104*b*.

Figure 15A:
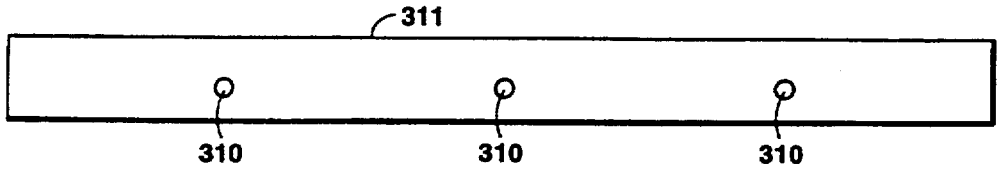
FIG. 15*a* and 15*b* are views of a base with pins attached.
Figure 15B:
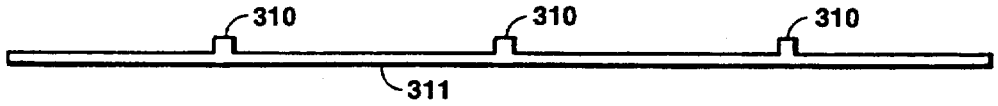
Figure 15:
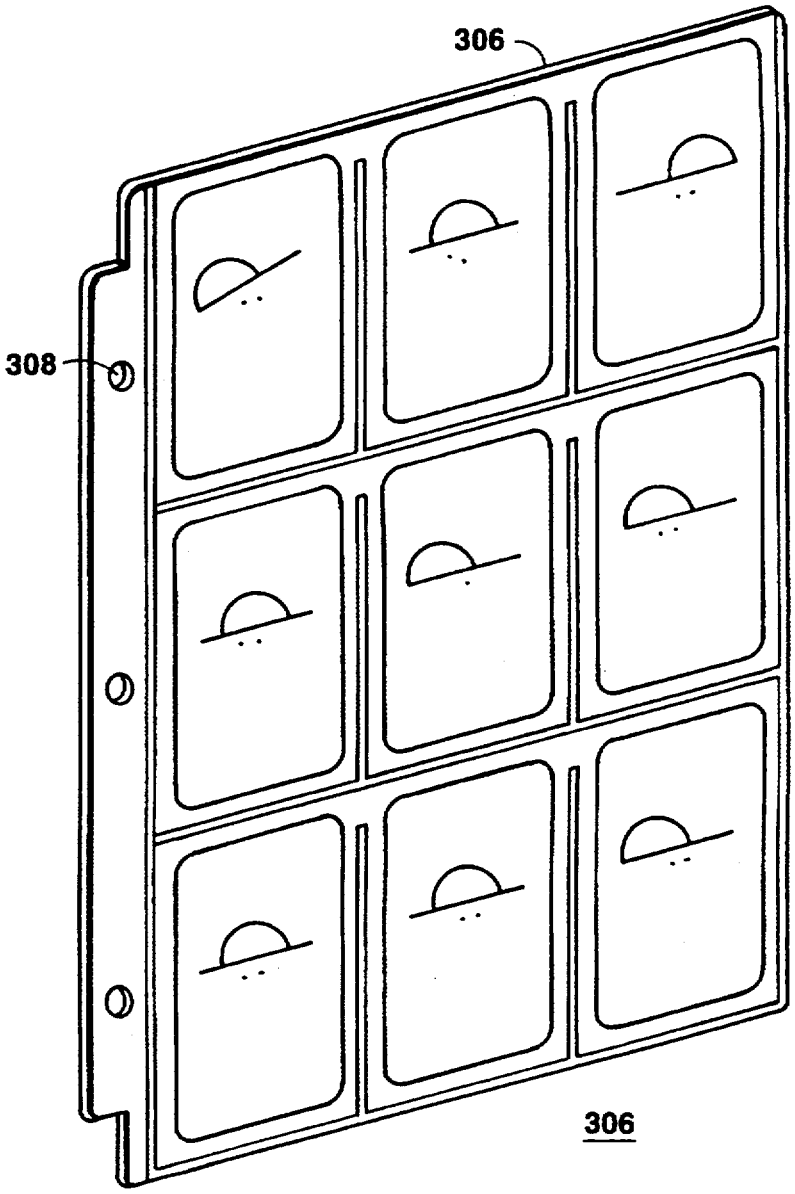
FIG. 15 is an isometric view of display materials in an album page having holes formed along an edge.

As an alternative, pins 310 may be attached to base 311, as shown in FIG. 15*a* and FIG. 15*b*. Pins 310 in base 311 may be, for example, inserted through existing holes 308 in album page 306, to secure placement in trough 304.

Assembled layers of picture frame assembly 300 are secured in place by application of retainer clips 122. Arrangement of retainer clips on back of picture frame assembly 300 may be as shown in FIG. 5. As with previous embodiment, hangar clip 124 may be used to enable wall display of picture frame assembly 300. Placement of hanger clip is as shown in FIG. 5.

Fourth Exemplary Embodiment

Figure 16:
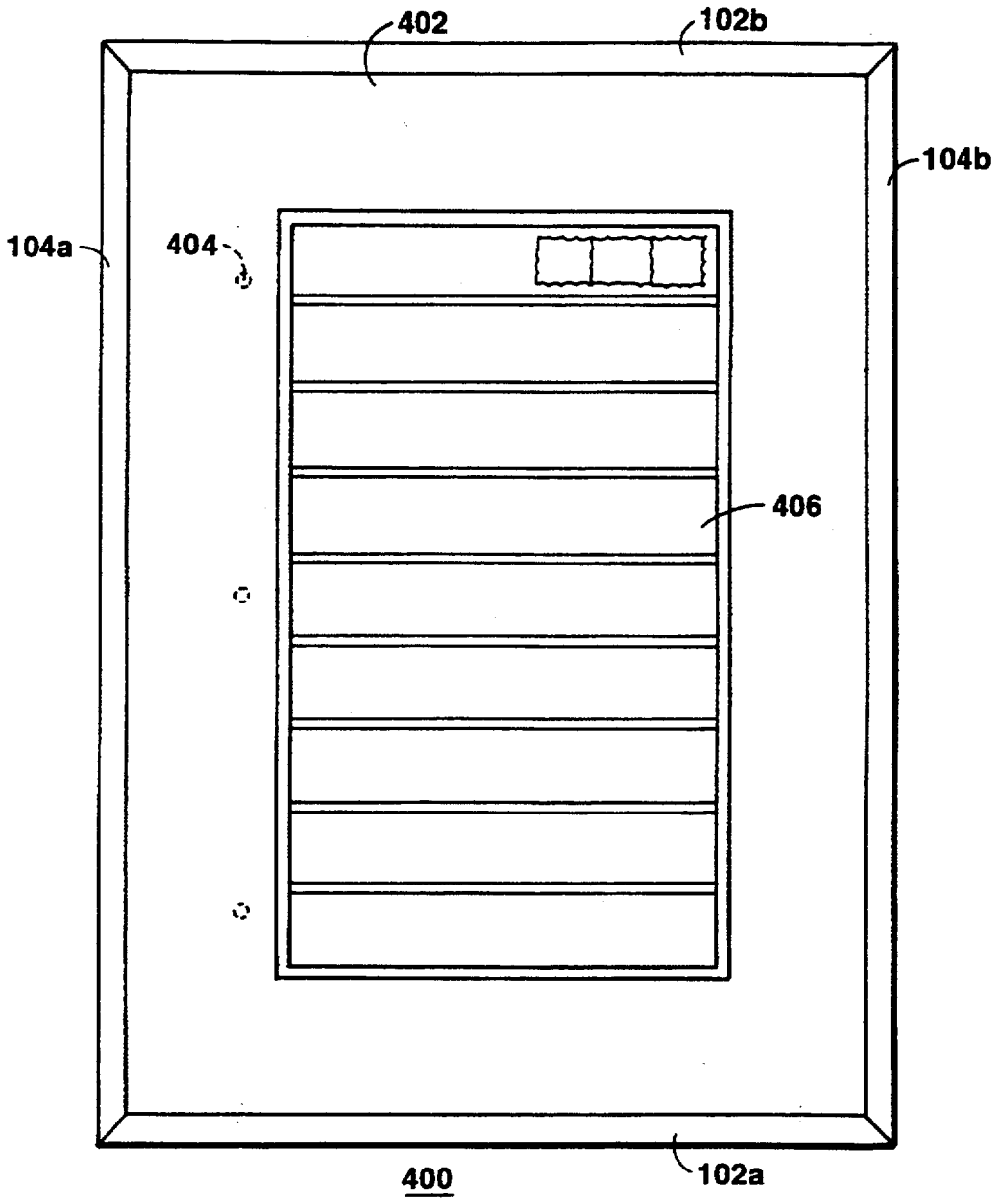
FIG. 16 is a front view of the picture frame assembly having small desired items mounted in pockets of an album page having pockets.

Referring now to FIG. 16, there is shown a front view of a fourth exemplary embodiment of the invention, picture frame assembly 400. In FIG. 16, mat 402 is used. Mat 402 is used for display of various album pages from collectors materials. FIG. 16, for example, displays an album page 406 of stamps. An alternate construction and means for mounting is employed with mat 402, described in detail below. Where like parts from previous embodiment are shown in the figures, like reference numbers are used. Where new parts are introduced in present embodiment, new reference numbers are used.

Figure 19A:
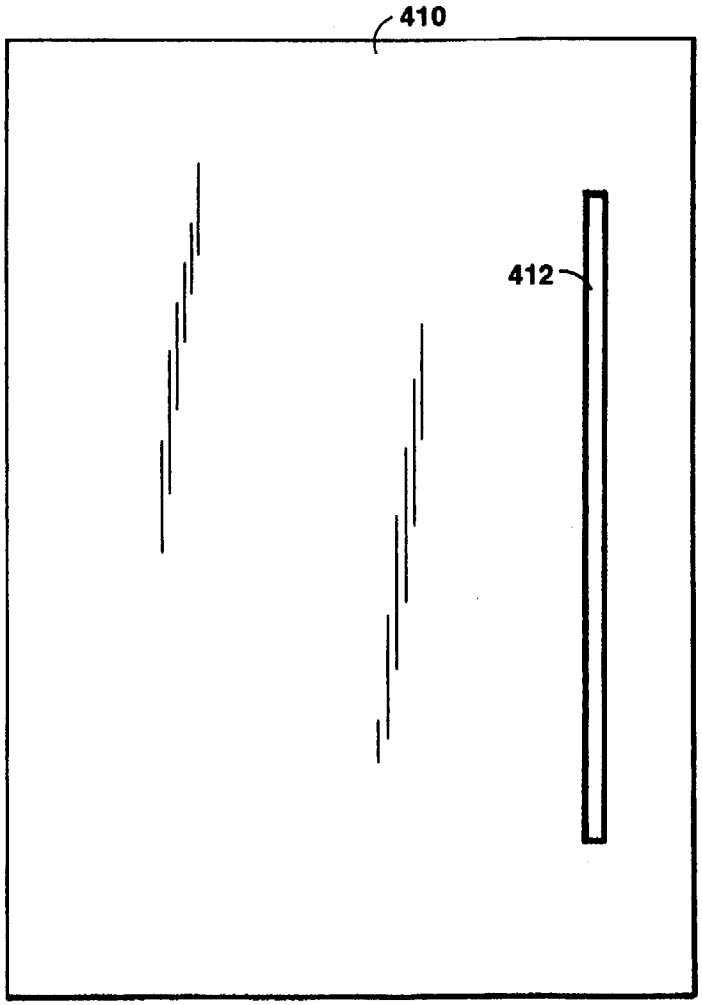
FIG. 19*a* is a front view of a backing board having a groove formed therein for support of pins.
Figure 17:
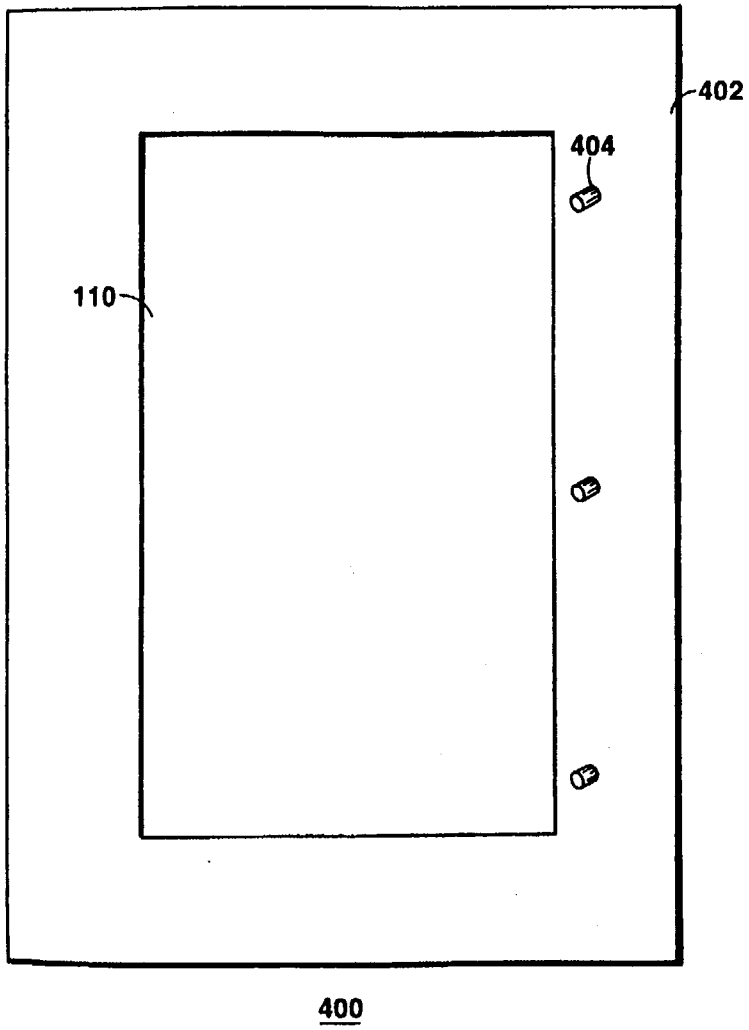
FIG. 17 is a rear view of a mat having pins attached thereto.
Figure 18:
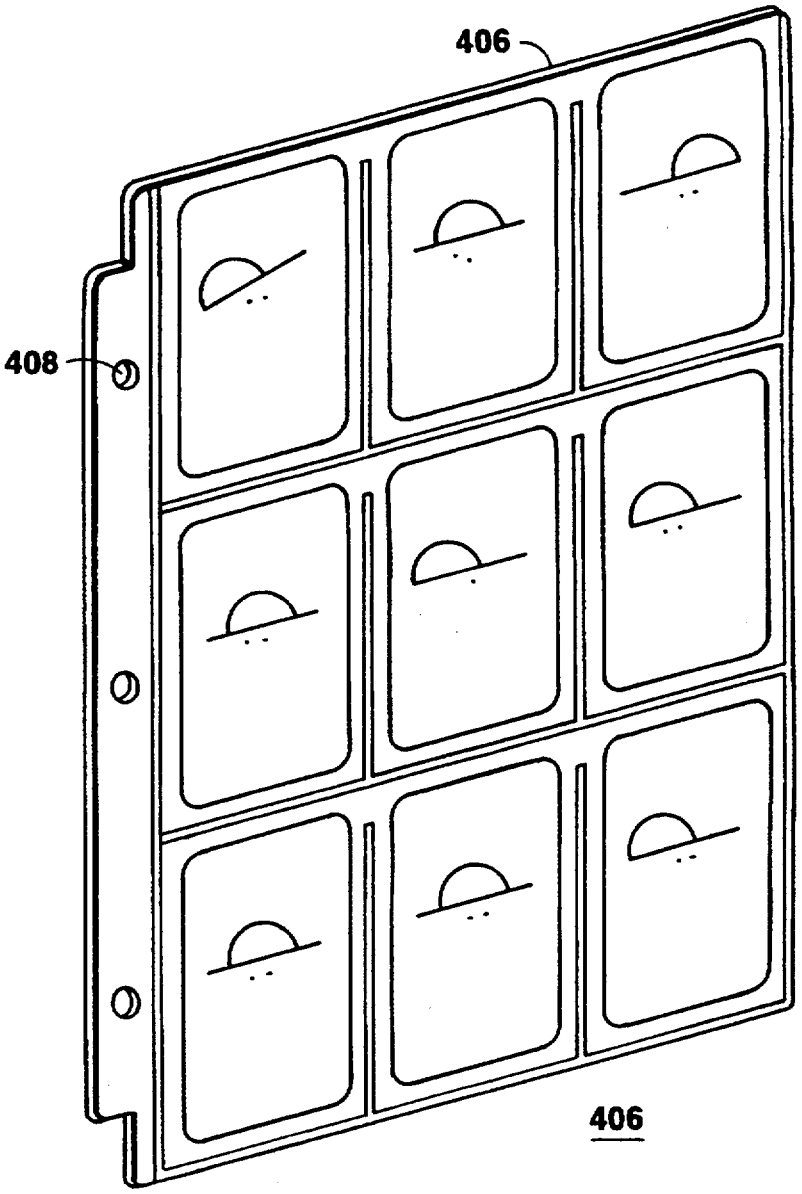
FIG. 18 is an isometric view of display materials in an album page having holes formed along an edge.
Figure 19B:
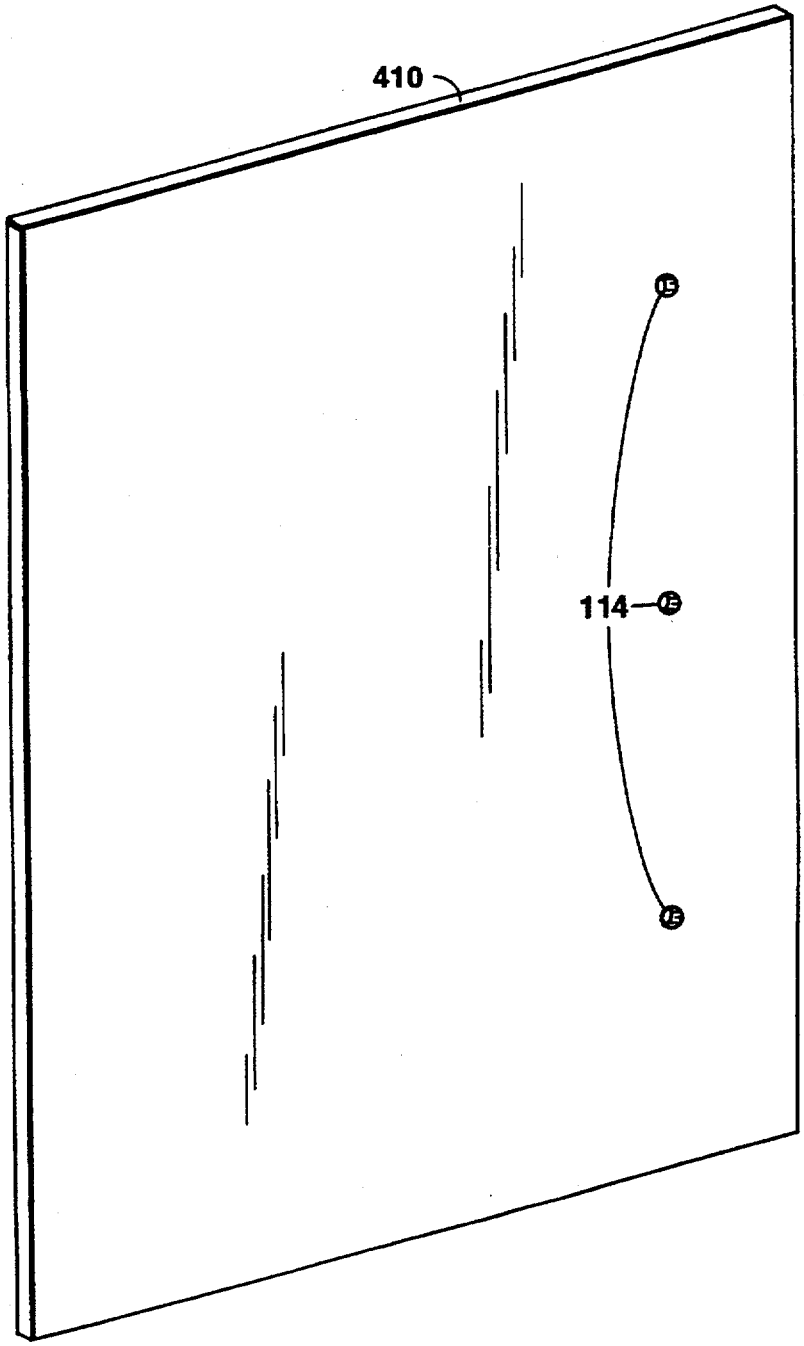
FIG. 19*b* is a front view of a backing board having holes formed therein for support of pins.
Figure 20:
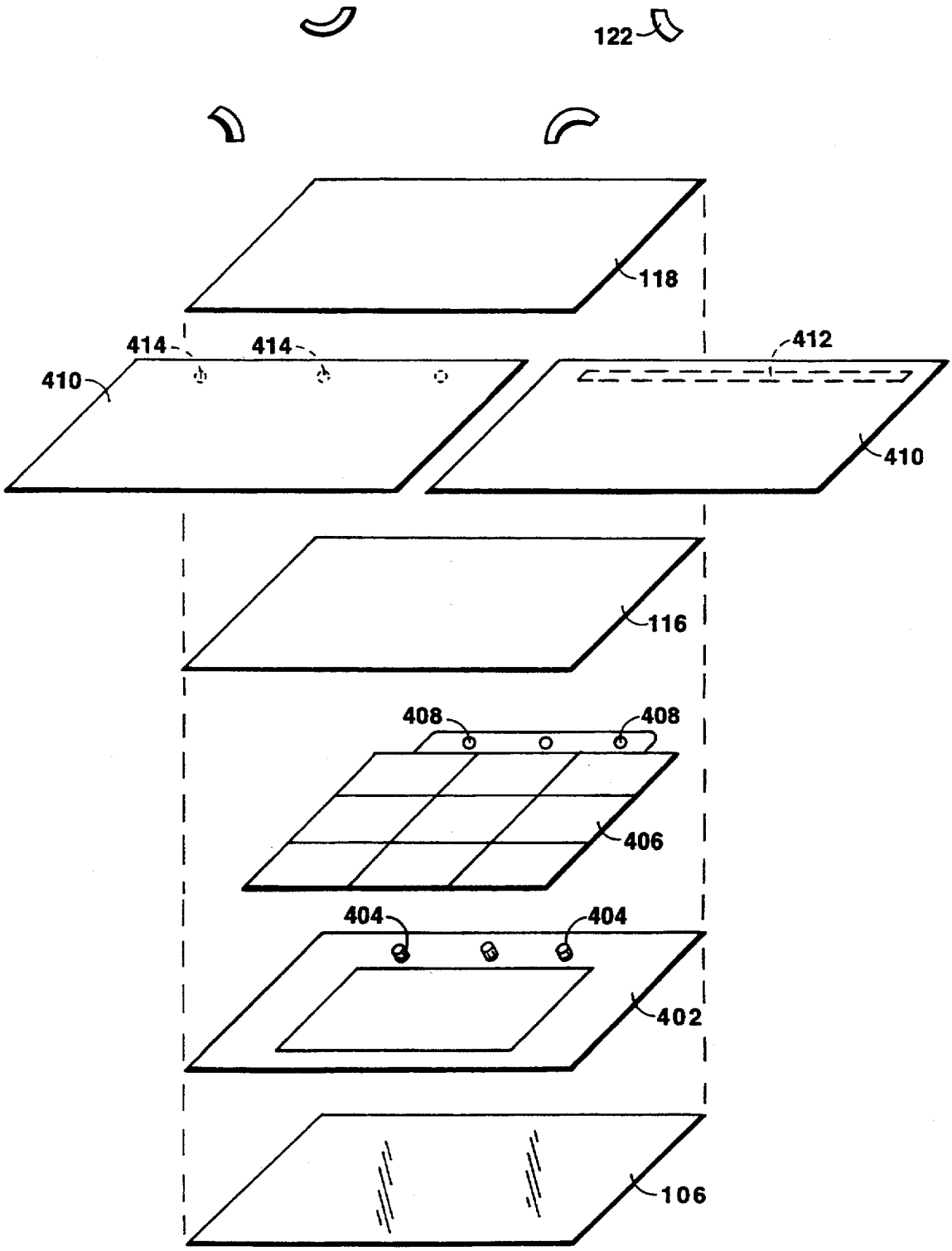
FIG. 20 is an exploded assembly drawing having displayed materials held in place by pins in either a groove or holes in a backing board.

In contrast to previous embodiments, present embodiment employs pins 404 attached to mat 402, as shown in FIG. 17. For example, pins 404 may be attached to mat 402 by glue or some other suitable adhesive. Many album pages have pre-existing punched holes. For example, in FIG. 18, where artwork 112 is an album page 406, pins 404 are placed through pre-existing punched holes 408 in album page 406. FIG. 18 is an isometric view of an album page 406. FIG. 19*a* shows backing board 410 with groove 412. FIG. 19*b* shows backing board 410 with holes 414. For example, pins 404 are inserted in groove 412 in backing board 410 to secure placement of album page 406 in picture frame assembly 400. As an alternative, pins 404 are inserted in holes 414 in backing board 410 to secure placement of album page 406. FIG. 20 is an exploded assembly drawing having an album page 406 held in place by pins 404 in either groove 412 or holes 414.

In a preferred embodiment of the invention it was found suitablae to make pins 404 from a ¼ wood dowel, and to insert the pins into a ¼ inch hole drilled in backing board 410. Wooden pins 404 cut from a ¼ inch dowel and having a length of between ¼ inch and ½ inch were found to satisfactorily hold in place an album page with pockets. The pockets are suitable for baseball cards or suitable for monetary currency, etc., so as to display several desired items in a picture frame.

Decorative sheet 116 is sized to engage, for example, assembled frame legs 102*a*, 102*b*, and 104*b*. Decorative sheet 116 does not engage frame leg 104*a* due to placement of pins 404 and groove 412 on baking board 410. FIG. 19*a* and 19*b* are front pictorial views of backing board 410. Backing board 410 is typically composed of styrofoam or laminated from board, sized to snugly fit within assembly frame legs 102*a*, 102*b*, 104*a*, 104*b*. Groove 412 is cut out of backing board 410 in order to receive the protrusion of pins 404 when assembled. Alternatively, holes 414 are cut out of backing board 410.

Assembled layers of picture frame assembly are secured in place by application of retainer clips 122. Arrangement of retainer clips on back of picture frame assembly 400 is shown as in FIG. 5. As with previous embodiment, hangar clip 124 may be used to enable wall display of picture frame assembly 400. Placement of hanger clip is as shown in FIG. 5.

Fifth Exemplary Embodiment

Figure 21:
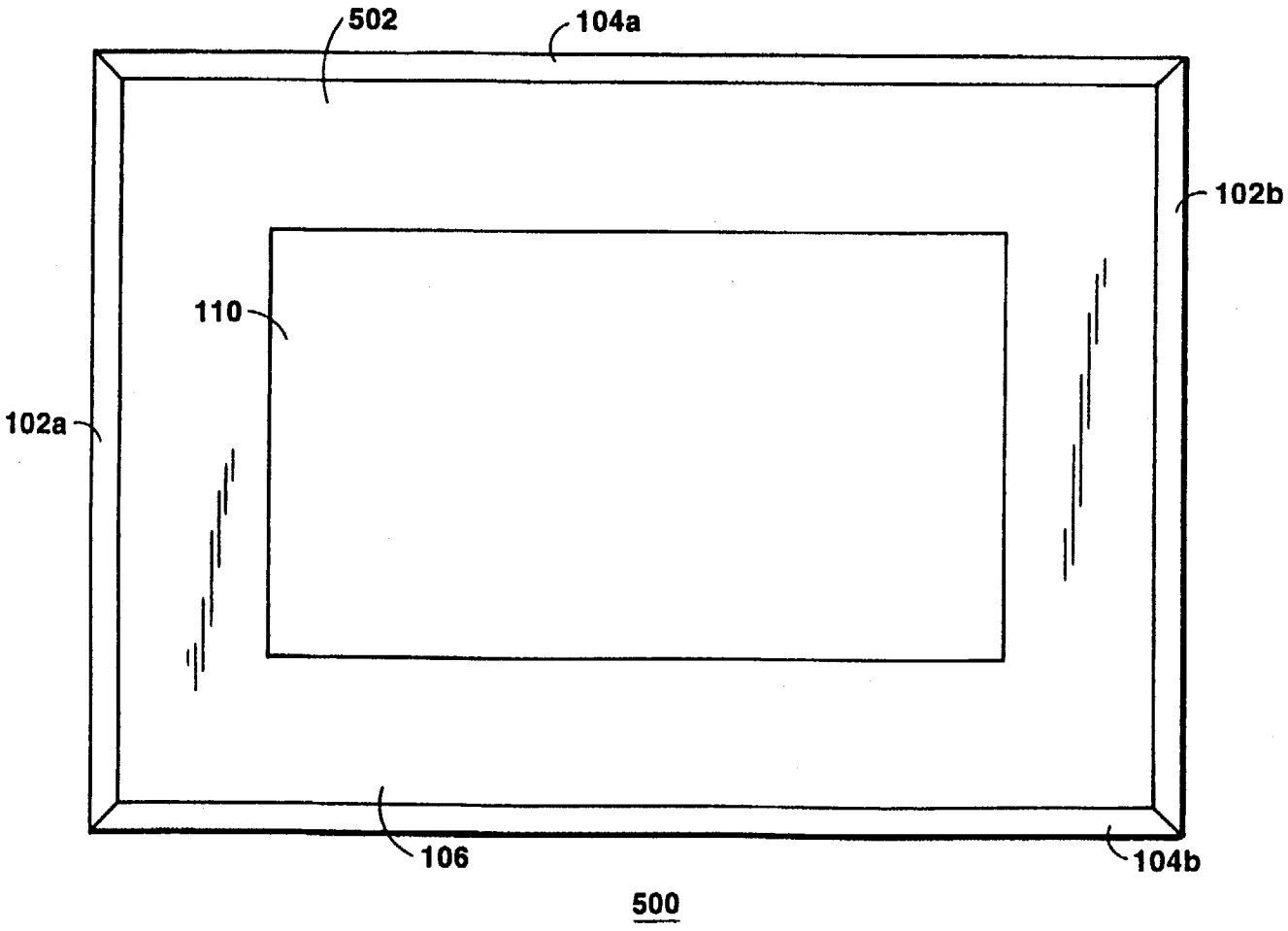
FIG. 21 is a front view of a display frame.

Referring now to FIG. 21, there is shown a front view of a fifth exemplary embodiment of the invention, picture frame assembly 500. In FIG. 21 mat 502 is used. This embodiment may be used for display of photographs and the like. An alternative construction and means for mounting is employed with mat 502, described in detail below. Where like parts from previous embodiment are shown in the figures, like reference numbers are used. Where new parts are introduced in present embodiment, new reference numbers are used.

Figure 22:
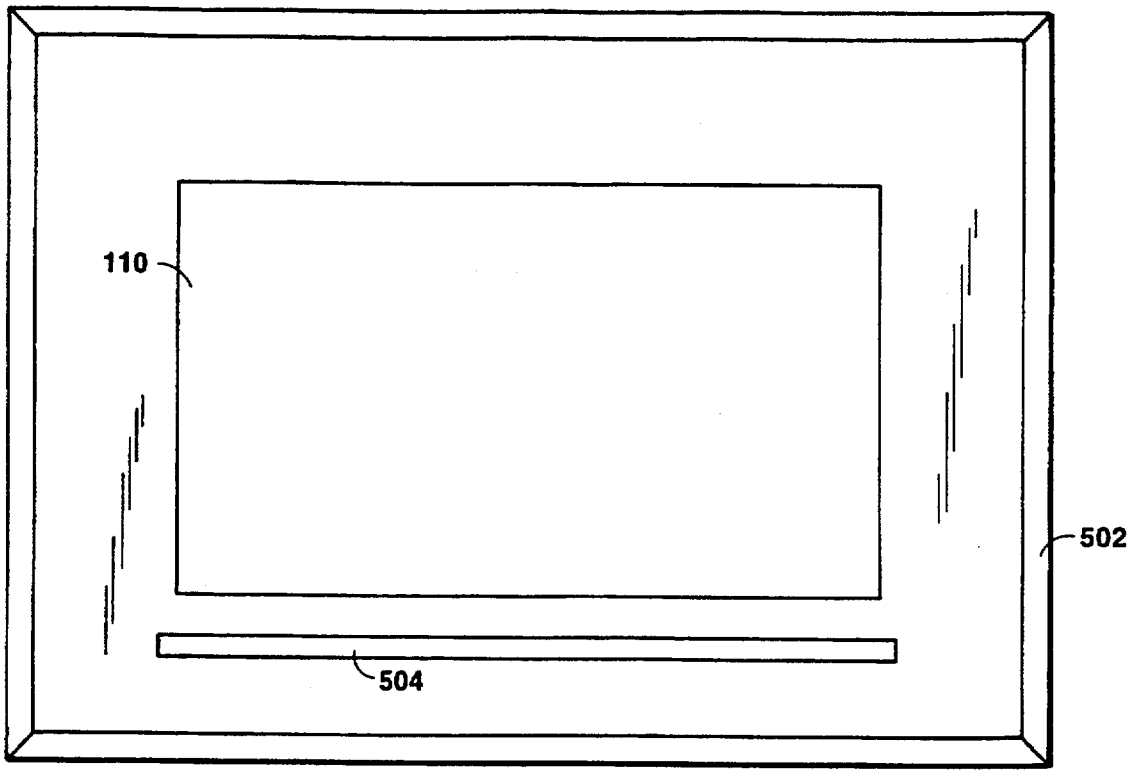
FIG. 22 is a rear view of a mat having an envelope pocket formed therein.

As shown in FIG. 22, mat 502 is constructed with envelope pocket 504. Position of envelope pocket 504 is similar to position of shelf 204 on mat 202 in second embodiment. Herein, rather than resting artwork 112 on, for example, shelf 204, envelope pocket 504 operates to receive bottom margin 506 on artwork 112.

Figure 23:
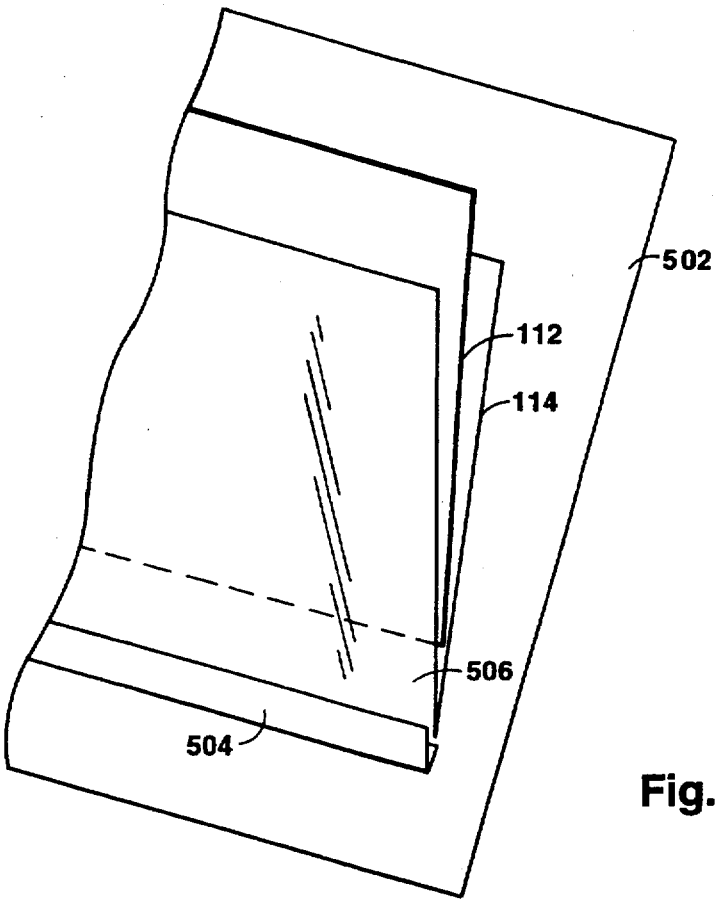
FIG. 23 is an exploded assembly drawing of folded transparent material placed in envelope pocket on mat.

Artwork 112 is encased in foldover MYLAR 114. Thus assembled, foldover MYLAR 114 with artwork 112 is slid into envelope pocket 504 on back of mat 502. FIG. 23 is an exploded assembly drawing of foldover MYLAR 114 placed in envelope pocket 504. Present invention also uses decorative sheet 116, sized to snuggly fit assembled frame legs 102*a*, 102*b*, 104*a*, 104*b*. Pressure board 117 of layered pressure assembly may also be used in present mounting method. Herein, pressure board 117 operates in conjunction with envelope pocket 504 to secure placement of artwork 112 in picture frame assembly 500. Backing board 118 shown in FIG. 3, from first embodiment, may also be used in present embodiment. Backing board 118 is typically composed of styrofoam or laminated foam board, sized to snugly fit within assembled frame legs 102*a*, 102*b*, 104*a*, 104*b*.

Assembled layers of picture frame assembly are secured in place by application of retainer clips 122. Arrangement of retainer clips on back of picture frame assembly 300 may be as shown in FIG. 5. As with previous embodiment, hangar clip 124 may be used to enable wall display of picture frame assembly 300. Placement of hanger clip is as shown in FIG. 5.

What is claimed is:

1. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

a retainer to hold said desired materials in said second opening of said mat, said retainer formed from at least one sheet of transparent material, said desired materials held by said retainer for viewing, said retainer having holes formed therein;

a backing board to form a back support in said frame to hold said transparent plate, said desired materials, said mat, and said retainer within said frame;

a pin passing through at least one of said holes in said retainer, said pin holding said retainer in fixed relationship to said mat;

attachment means for fastening said backing board within said frame to anchor said backing board to form said back support.

2. The apparatus as in claim 1 further comprising:

said at least one pin is positioned in a hole in said backing board.

3. The apparatus as in claim 1 further comprising:

said at least one pin is formed from durable material, and said pin is molded to a base, and said base fits into an opening in said backing board.

4. The apparatus as in claim 1 further comprising:

said at least one pin is positioned in a hole in said mat.

5. The apparatus as in claim 1 further comprising:

said at least one pin is plastic and is molded to a base, and said base fits into an opening in said mat.

6. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

a retainer to hold said desired materials in said second opening of said mat;

a backing board to form a back support in said frame to hold said transparent plate, said desired materials, said mat, and said retainer within said frame;

attachment means for fastening said backing board within said frame to anchor said backing board to form said back support; at least one pin positioned in a hole in said mat, said at least one pin passing through a hole in said retainer to hold said retainer in place relative to said mat.

7. The apparatus as in claim 6 further comprising:

said at least one pin is plastic and is molded to a base, said base fits into an opening in said mat.

8. The apparatus as in claim 6 further comprising:

said retainer is a plastic sheet having at least one hole formed along one side, and having at least one plastic pocket formed in said retainer.

9. The apparatus as in claim 6 further comprising:

said transparent plate is transparent to light in the visible wavelength range and absorbent in the ultra-violet wavelength range to protect said desired materials from ultra-violet wavelength radiation striking said transparent plate.

10. The apparatus as in claim 6 further comprising:

said transparent plate is made of ultra-violet absorbing glass.

11. The apparatus as in claim 6 further comprising:

said transparent plate is made of ultra-violet absorbing plastic.

12. The apparatus as in claim 6 further comprising:

said transparent plate is transparent to light in the visible wavelength range and reflective in the ultra-violet wavelength range to protect said desired materials from ultra-violet wavelength radiation striking said transparent plate.

13. The apparatus as in claim 6 further comprising:

said transparent plate is made of ultra-violet reflecting glass.

14. The apparatus as in claim 6 further comprising:

said transparent plate is made of ultra-violet reflecting plastic.

15. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said of said transparent plate, said mat having a second opening, said second opening forming a window for viewing said desired materials, said second opening in said mat being smaller than said first opening formed by said frame;

a retainer to hold said desired materials in said second opening of said mat, said retainer is a sheet having at least one hole formed along one side, and having at least one pocket formed in said retainer;

a backing board to form a back support in said frame to hold said transparent plate, said desired materials, said mat, and said retainer within said frame;

attachment means for fastening said backing board within said frame to anchor said backing board to form said back support;

at least one pin positioned in a hole in said backing board to hold said desired materials in place.

16. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

a retainer to hold said desired materials in said second opening of said mat;

a backing board to form a back support in said frame to hold said transparent plate, said desired materials, said mat, and said retainer within said frame;

attachment means for fastening said backing board within said frame to anchor said backing board to form said back support;

at least one pin positioned in a hole in said backing board, said at least one pin passing through a hole in said retainer to hold said retainer in place relative to said backing board.

17. The apparatus as in claim 16 further comprising: said at least one pin is plastic and is molded to a base.

18. The apparatus as in claim 17 wherein said at least one pin further comprises three pins molded into one base.

* * * * *